US006886378B1

(12) United States Patent
Harris et al.

(10) Patent No.: US 6,886,378 B1
(45) Date of Patent: May 3, 2005

(54) CONTAINER LOCKING SYSTEM

(75) Inventors: Thomas Donovan Harris, El Toro, CA (US); Darin Allen Harris, El Toro, CA (US)

(73) Assignee: Sun Pacific Systems, Inc., El Toro, CA (US)

( * ) Notice: Subject to any disclaimer, the term of this patent is extended or adjusted under 35 U.S.C. 154(b) by 165 days.

(21) Appl. No.: 10/315,965

(22) Filed: Dec. 9, 2002

(51) Int. Cl.[7] ..... E05B 65/06

(52) U.S. Cl. ..... 70/129; 70/56; 70/212; 292/218

(58) Field of Search ..... 70/129, 417, 54–56, 70/2–13, 202, 203, 211–212; 292/218, DIG. 32, 259 A, 259 R

(56) References Cited

U.S. PATENT DOCUMENTS 4,742,701 A * 5/1988 Scavetto ..... 70/121
4,768,816 A * 9/1988 Bakula ..... 292/218
4,885,919 A 12/1989 Loughlin et al. ..... 70/34
4,895,007 A * 1/1990 Eberly ..... 70/54
4,898,008 A * 2/1990 Eberly ..... 70/56
5,000,494 A * 3/1991 Guibleo ..... 292/148
5,029,909 A * 7/1991 Bunger ..... 292/40
5,092,143 A * 3/1992 Rumbles ..... 70/56
5,118,149 A * 6/1992 Emmons ..... 292/327
5,261,258 A * 11/1993 Bunger ..... 70/56
5,477,710 A 12/1995 Stefanutti ..... 70/56
5,509,700 A * 4/1996 Kennedy, Jr. ..... 292/3
5,743,118 A * 4/1998 Anderson ..... 70/56
5,775,747 A 7/1998 Navarsky ..... 292/307
5,782,115 A * 7/1998 Judy ..... 70/164
6,009,731 A 1/2000 Emmons et al. ..... 70/56
6,010,166 A * 1/2000 Hamilton et al. ..... 292/282
6,065,314 A * 5/2000 Nicholson ..... 70/212
6,367,292 B1 * 4/2002 Bunger ..... 70/56
6,508,087 B2 * 1/2003 Lemley et al. ..... 70/56
6,519,982 B1 * 2/2003 Brammall et al. ..... 70/56
6,581,425 B1 * 6/2003 Brown et al. ..... 70/212
6,592,155 B1 * 7/2003 Lemley et al. ..... 292/7
6,622,533 B1 * 9/2003 Santini ..... 70/56

* cited by examiner

*Primary Examiner*—Suzanne Dino Barrett
(74) *Attorney, Agent, or Firm*—K. David Crockett, Esq.; Crockett & Crockett

(57) ABSTRACT

A system for locking cargo containers. The container locking system comprises a lock housing comprising a box, a lock bar housing disposed behind the lock housing, a lock bar disposed within the lock bar housing, a staple attached to the lock bar, a slot disposed between the lock housing and the lock bar housing, and a lock. The staple translates and rotates as the lock bar translates and rotates. The staple may be disposed in the slot and accessed from an opening in the front of the lock housing. A shackle of the lock may be disposed through a hole in the staple, thus securing the system.

19 Claims, 5 Drawing Sheets

CONTAINER LOCKING SYSTEM

FIELD OF THE INVENTIONS

The inventions described below relate to the field of security systems and locks, especially for cargo containers.

BACKGROUND OF THE INVENTIONS

Providing only simple locks, such as padlocks or combination locks, on cargo containers is often ineffective at deterring thieves. The thief may use a crowbar, blowtorch, bolt cutter, or any number of other means to break the lock and then access the contents of the container. Thus, devices have been proposed to protect the lock from being surreptitiously removed. For example, Bunger, Padlock Protector, U.S. Pat. No. 5,261,258 (Nov. 16, 1993) shows a padlock disposed within a housing that closely fits around the lock. Another patent to Bunger, Padlock Protector, U.S. Pat. No. 6,367,292 (Apr. 9, 2002) shows the closely fitting casing disposed within a housing. Eberly, Padlock Protector, U.S. Pat. No. 4,898,008 (Feb. 6, 1990) shows a housing that encloses a portion of the shackle of the padlock.

However, all of the devices described above are potentially vulnerable to drills, blow-torches, or to freezing devices since the lock actuator (key, tumbler, or other mechanism), the lock, or the area near the lock can still be easily reached. Thus, more secure devices are needed to protect locks, especially on containers that may be left unattended for extended periods of time.

SUMMARY

The methods and devices shown below provide for a locking system for portable containers that protects a lock from tampering. The lock is disposed deep within a box sized and dimensioned to allow a user to reach the lock with a hand or a key, but difficult to reach with any tools suitable for tampering with the lock.

Behind the box (inside of the container door), a lock bar housing is attached to the box. A lock bar is disposed within the lock bar housing such that the lock bar may not be seen or accessed through the box. The lock bar may extend into a corresponding hole in the container. When the lock bar is disposed in the hole the container door may not be opened. The lock is disposed such that it prevents the lock bar from moving when the lock is engaged, whereby the lock secures the container door.

A staple is disposed in the lock bar housing and is attached to the lock bar such that the staple may translate and rotate as the lock bar translates and rotates. The staple may fit within a slot disposed between the box and the lock bar housing. The staple is provided with a hole through which a lock shackle may be disposed. (The staple and lock prevents the lock bar from moving when the lock is engaged). The slot, staple and lock may be sized and dimensioned so that the lock fits snugly inside the box when the lock is engaged, thereby making it more difficult to tamper with the lock.

DETAILED DESCRIPTION OF THE INVENTIONS

Figure 1:
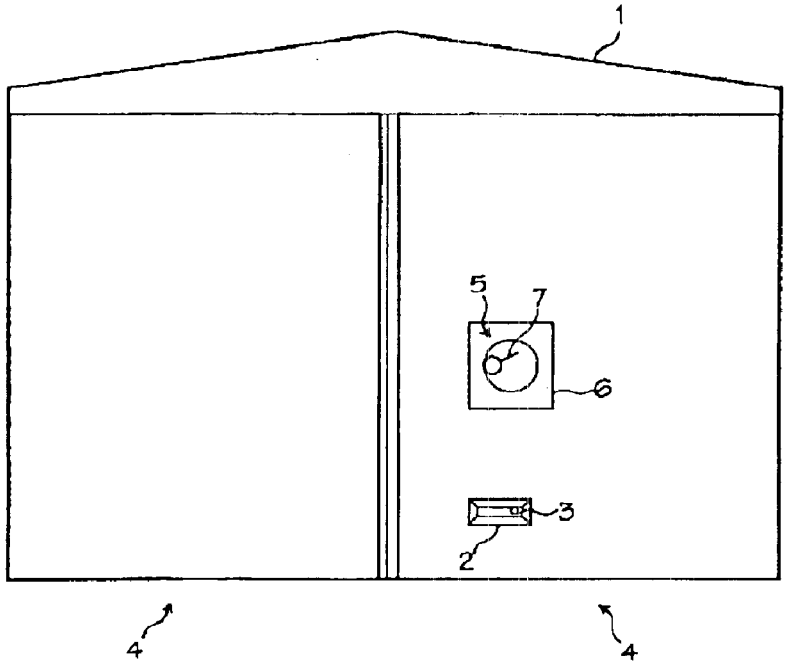
FIG. 1 shows a cargo container having a container locking system.

FIG. 1 shows a cargo container 1 having a container locking system. The container locking system (or door closure system) may comprise a lock housing 2, a lock 3, a lock bar housing, a lock bar and a staple. The lock housing may comprise a metal box or may be a recess in the container door 4. (The door may be characterized has having an inner surface and an outer surface, where the inner surfaces faces the inside of the container when the door is closed). An opening is provided in the lock housing such that the opening is flush against (substantially coplanar with) an opening or aperture in the door. Thus, the lock housing may not be accessed except through the opening. The lock housing and opening are sized and dimensioned so that a hand and a small tool, such as a key, may fit within the opening but larger tools may not easily work within the opening.

A lock 3 may be disposed inside the lock housing 2 and may comprise a hidden shackle padlock (or other lock). The shackle of the lock may be disposed such that the doors may only be opened or closed if the shackle is removed. The doors may be opened by operating a door closure system 5 (or lock bar translating mechanism) disposed on the door or within a recess 6 in the door 4. A lock bar actuator 7 is disposed within the recess, and may be moved within the recess to operate the door closure system. In addition to the container locking system, a padlock or other lock may be provided on the door closure system for additional security, by for example, locking the actuator to staple disposed within the recess. Thus, the recess 6 will typically be sized and dimensioned to accommodate the throw of the actuator and a lock.

Figure 2:
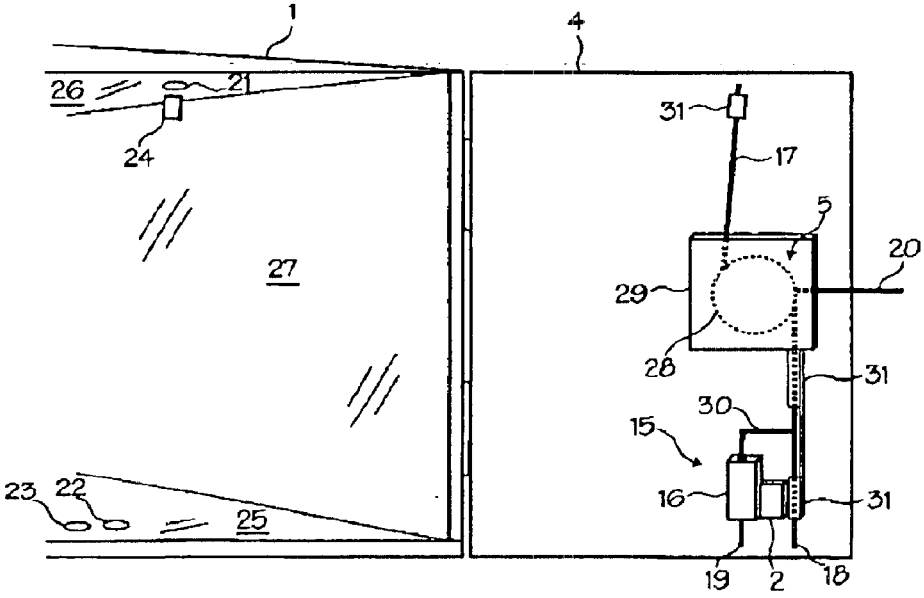
FIG. 2 shows the inside of the cargo container door, a door closure system and a door securing system.

FIG. 2 shows the inside of the cargo container door 4, a door closure system 5 and a container locking system 15. The container locking system (securing system or lock protector) may comprise a lock housing 2, a lock 3, a lock bar housing 16 and one or more lock bars 17, 18, 19 and 20. (A lock bar may comprise a rigid lock bar, lug, rod, bar or beam that serves to prevent the door from opening when engaged in a locked position).

The lock bars 17, 18, 19 and 20 are moveable with respect to the door 4 so that the lock bars may be selectively engaged with corresponding apertures or holes 21, 22 and 23 or securing guides 24 disposed in or on the cargo container 1. The holes 21, 22 and 23 serve as keepers, and any other suitable keeper structure may be used. The holes or securing guides may be disposed on the container floor 25, ceiling 26, walls 27 and doors 4; in addition, the holes may be blind holes or may allow the lock bars to extend into the ground. More generally, the apertures or holes may be provided in the container or in other structures attached to the container. The apertures or holes may have the form of a cylinder or other shape conforming to the shape of the lock bar. When the lock bars are inserted into the holes or securing guides the container doors may not be opened.

At least one lock bar 19 passes through a lock bar housing 16. The lock bar housing is attached to the lock housing 2 and a staple receiving slot is provided between the lock bar housing and the lock housing. A staple is disposed on the lock bar and fits through the slot to protrude into the lock housing. The staple may comprise a lug, a keeper, a hasp, a protrusion from the lock bar, a block, fastener, or other object having an aperture capable of receiving the shackle of a lock. The staple may be accessed through the opening of the lock housing (from the outside of the container door). The shackle of a lock may be placed through an aperture or hole in the staple, preventing the lock bar from moving and thereby securing the container door.

The door closure system 5 may comprise a wheel 28 disposed within a housing 29 and one or more of the lock bars 17, 18, 19 and 20 operably connected to the wheel. When an actuator, accessible from outside the container door, is turned, the wheel is also turned. The wheel causes the lock bars to move. In one embodiment an upper lock bar 17 moves up and down relative to a corresponding hole 21 disposed in the container's ceiling 26, and a first lower lock bar 18 and a second lower lock bar 19 move up out of and down into corresponding holes 22 and 23 disposed in the container floor 25. The first lower lock bar 18 and the second lower lock bar 19 may be fixed together vertically so that they may be operated simultaneously with a single manipulation of the door closure system. A rigid cross-member 30 may serve to fix the first lower lock bar and the second lower lock bar together. In another embodiment an optional cross lock bar 20 is moveable from side to side relative to the container door 4. The cross lock bar either directly bars the other door or is inserted into a securing guide on the other door. When the cross lock bar is engaged the doors are secured to each other. In another embodiment the door actuating mechanism may comprise a lever operable to simultaneously move the lock bars. (An example of such a mechanism is found in Nicholson, Lock for Freight Containers, U.S. Pat. No. 6,065,314 (May 23, 2000), the entirety of which is hereby incorporated by reference). In other embodiments one or more additional lock bars may be provided that move up and down, side to side, or diagonally relative to the container doors. In any of the embodiments, one or more lock bar guides 31 may be provided to ensure that the lock bars only move in desired directions.

Figure 3:
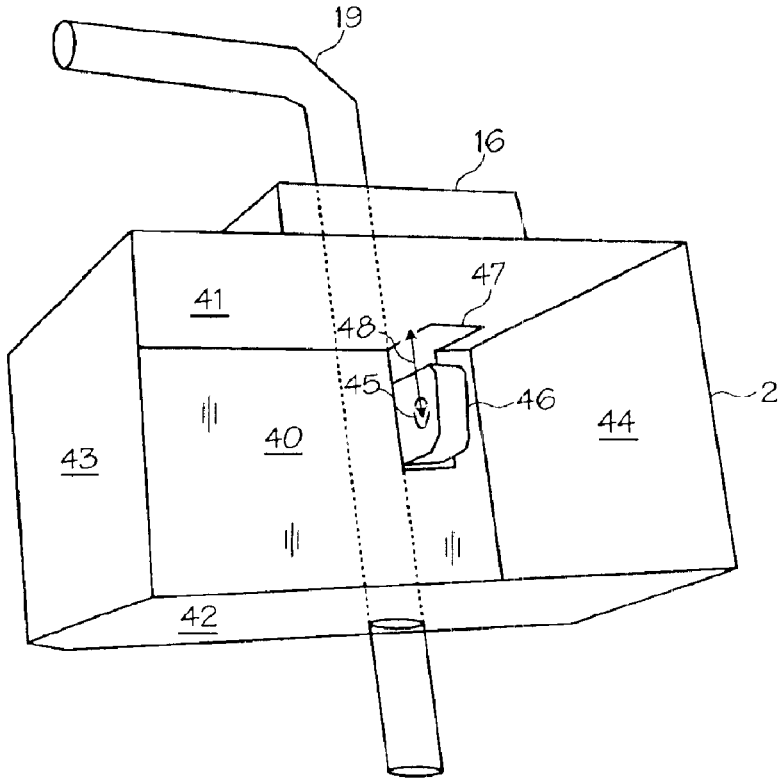
FIG. 3 shows a close-up view of the lock housing, without a lock, as seen from the front.
Figure 4:
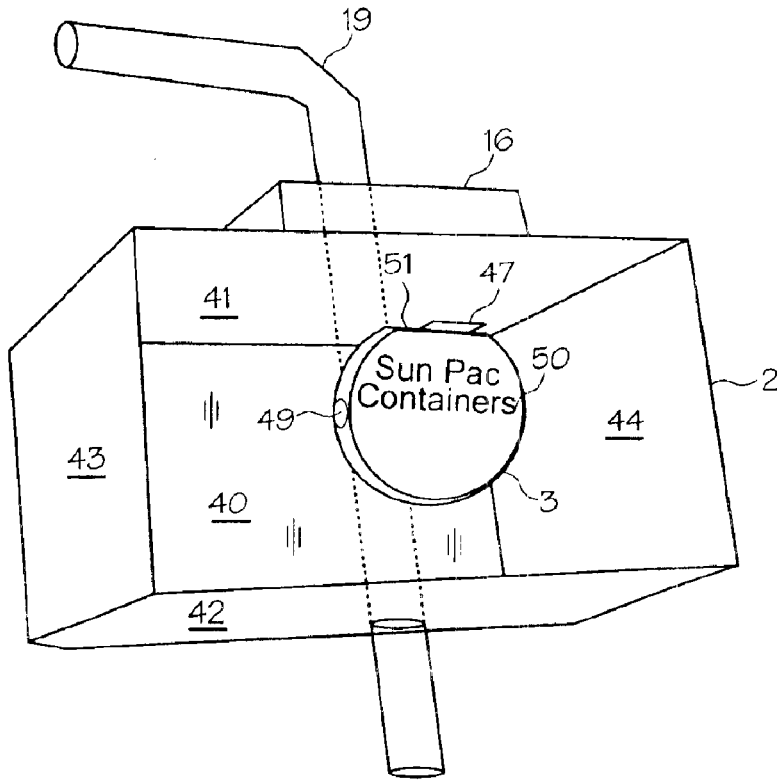
FIG. 4 shows a close-up view of the lock housing, with a padlock, as seen from the front.

FIGS. 3 and 4 show a close-up view of the lock housing 2 as seen from the front. The lock housing may comprise a metal box having one open side, though the housing may comprise other hard substances (such as plastics or ceramics). The lock housing 2 more generally comprises a back surface or wall 40, a ceiling 41, a floor 42, a first side wall 43 and a second side wall 44 attached to each other to form an open rectangular box. The material and thickness of the walls prevent a thief from accessing a lock except through the opening. The lock housing is sized and dimensioned to allow a person to insert a hand or a hand and a small tool, such as a key, into the housing. However, the lock housing is sufficiently narrow and deep that the housing prevents a person from using most tools that would be needed to tamper with the lock. In one embodiment the lock housing is about 6.5 inches wide, about 4.5 inches tall and about 6 inches deep; however, each of the lock housing dimensions may be larger or smaller (all dimensions are described relative to the container). Thus, a typical crowbar cannot be used to pry the lock off the staple, and the lock tumbler or shackle is not accessible to a drill.

In FIG. 3, the lock is not shown in order to reveal the details of the housing slot and staple. The shackle of a lock may be disposed through a hole 45 in staple 46 (or keeper element or lock catch). The staple is attached to a lock bar 19 and moves back and forth (with respect to the lock housing) as the lock bar moves back and forth. (In other embodiments where the lock bar can rotate, the staple also rotates with the lock bar). The lock bar is disposed in the lock bar housing 16 and the lock bar housing is disposed on the back of the lock housing 2. (Part of the lock bar is shown in phantom to indicate that the lock bar passes through the lock bar housing behind the lock housing. The lock bar may not be seen or accessed through the lock housing, except, perhaps, through the slot). An L-shaped slot 47 is provided between two walls of the lock bar housing and lock housing such that the staple may move between the lock housing and the lock bar housing, passing upwardly through that portion of the slot disposed in the lock housing ceiling 41. The slot, however, may have different shapes and may be located elsewhere in the lock bar or lock housings. The slot may be sized and dimensioned such that the staple moves only a short distance within the lock housing. The distance between the hole 45 in the staple and the ceiling 41 of the lock housing is represented by arrows 48.

Where the first lower lock bar 18 is not fixed to the second lower lock bar 19 the second lower lock bar 19 may be rotated so that the staple 46 rests on the outside of the ceiling 41 of the lock housing (the staple will still be disposed within the lock bar housing), thereby holding the container locking system open. The lock bar housing 16 may be sized and dimensioned such that the lock bar may fully disengage from any holes in the container and yet the staple will still remain within the lock bar housing. (Though in other embodiments the lock bar housing may be provided with an opening to allow the staple to move outside the lock bar housing).

FIG. 4 shows the lock housing 2, with a lock 3, as seen from the front. The shackle of the lock is disposed through the hole 45 and secures the lock to the staple 46. The body of the lock prevents the staple from moving through the slot 47, thereby securing the lock bar 19. The lock may be a hidden shackle padlock, having a key hole 49, or may be a combination lock or any other lock. The key hole or lock cylinder faces towards the longer dimension of the lock housing (sideways) so that a user may insert and manipulate a key into the key hole. The lock may be provided with a trademark 50 or other marketing message, allowing a user to identify the unique locks designed to work with the container locking system 15.

The lock may be further sized and dimensioned so that the lock abuts (is disposed along the edge of) one or more of the walls of the lock housing when the lock shackle is disposed through the staple. The slot may be further sized and dimensioned such that the distance represented by arrows 48 corresponds to the distance between the shackle and the edge 51 of the lock. Thus, the lock may fit securely against at least one wall, or against a corner of the lock housing. When secured snugly against one or more walls or in a corner of the lock housing, the lock is more difficult to access with tampering tools.

Figure 5:
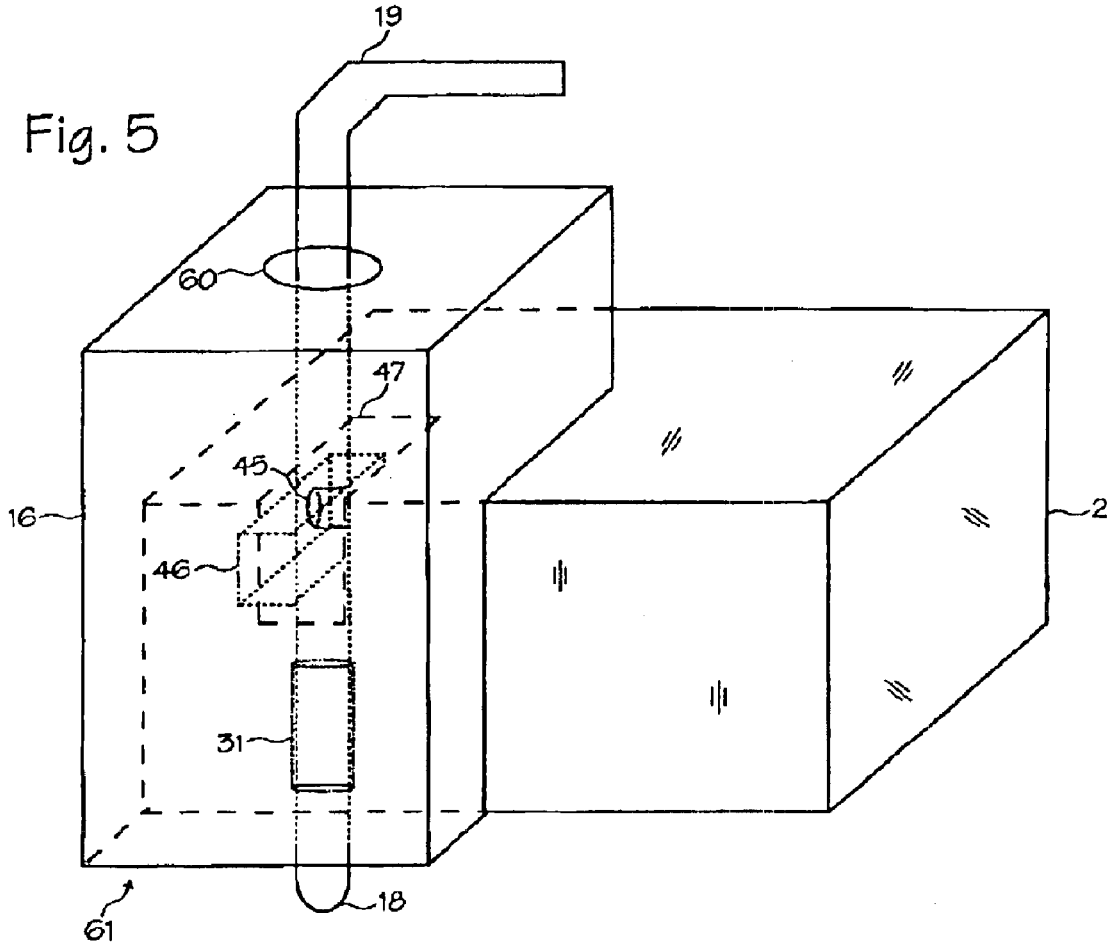
FIG. 5 shows the lock housing and lock bar housing as seen from inside the container door.

FIG. 5 shows the lock housing 2 and lock bar housing 16 as seen from inside the container door. The lock bar housing is attached to the lock housing. The lock bar 19 extends through openings 60 and 61 in the top (60) and bottom (61) of the lock bar housing. (Part of the lock bar is shown in phantom to show that it is disposed within the lock bar housing). The lock bar may be disposed through a lock bar guide 31 to keep the lock bar oriented correctly in the lock bar housing as the lock bar moves. (The lock bar guide is shown in phantom to indicate its position inside the lock bar housing). The lock bar guide may be attached anywhere to the lock bar housing so long as the staple 46 may move in and out of the slot 47. The staple is attached to the lock bar so that the staple rotates and translates as the lock bar rotates and translates. (The staple is shown in phantom to indicate that the staple may be disposed within the lock bar housing, the slot and the lock housing). The shackle of a lock may be disposed through the hole 45 in the staple, thus securing the staple within the lock housing and also securing the lock bar relative to the lock and lock bar housings. In some embodiments, the lock bar may be raised and rotated such that the staple rests on the top of the lock housing, thereby keeping the lock bar in an unlocked position.

Figure 6:
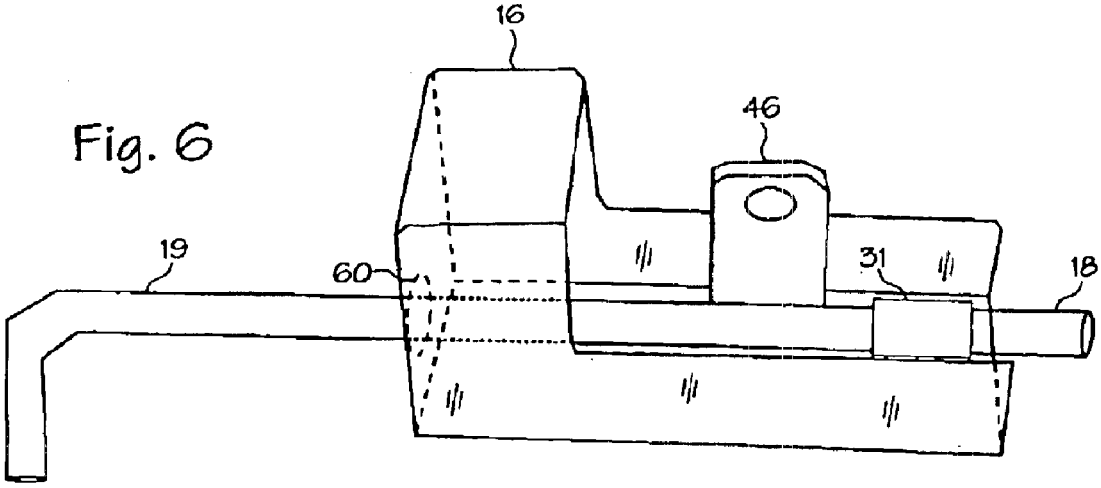
FIG. 6 shows the lock bar housing, the lock bar, the staple and a guide for the lock bar.

FIG. 6 shows the lock bar housing 16, the lock bar 18, the staple 46 and a guide 31 for the lock bar. The lock bar is disposed through the lock bar guide and an opening 60 in the top of the lock bar housing. The lock bar guide and opening keep the lock bar in a particular orientation as the lock bar translates (and rotates, if not secured to the first lower lock bar 18). The staple is attached to the lock bar and translates with the lock bar. The lock bar guide is attached to the lock bar housing and the lock bar is moveable through the lock bar guide.

Figure 7:
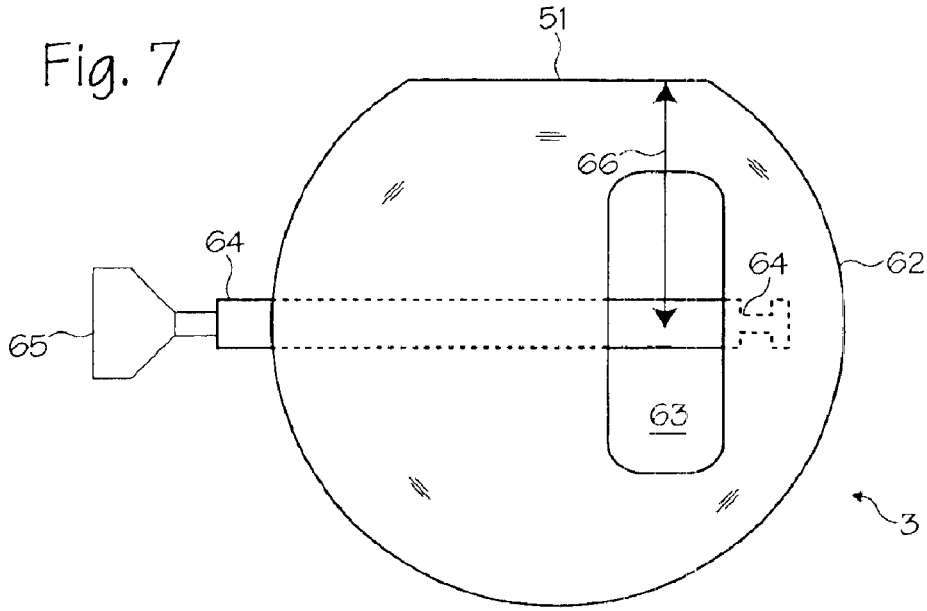
FIG. 7 shows a padlock suitable for use with the container locking system of FIGS. 1 through 6.

FIG. 7 shows a padlock 3 suitable for use with the container locking system 15 of FIGS. 1 through 6. The lock case 62 is provided with a flat edge 51 so that the lock may easily abut one of the flat walls of the lock housing. The lock is provided with an aperture or opening 63 sized and dimensioned to receive the staple. A shackle 64 may translate back and forth within the lock opening. The shackle is disposed within the padlock such that the shackle may be disposed through the hole in the staple and into the other side of the lock. (Part of the shackle 64 is shown in phantom to indicate that it disposed inside the lock case 62). The shackle is operatively connected to an actuating mechanism capable of both securing the shackle in a locked position and moving the shackle in and out of the lock opening. A key 65 may be used to operate the actuating mechanism.

The distance between the center of the shackle and the outside flat edge of the lock is represented by arrows 66. The lock and shackle may be sized and dimensioned such that the distance between arrows 66 is approximately the same as the distance between arrows 48 of FIG. 3. Thus, when the lock is placed inside the lock housing and the shackle is secured through the hole in the staple, the lock may snugly abut one or more walls of the lock housing. The slot may be sized and dimensioned so that the staple may not move when the lock is disposed on the staple. When so disposed, the lock fits snugly within the lock housing, thereby increasing the difficulty of tampering with the lock.

In addition, because the lock is paired or mated with the container locking system, only a particular lock designed for the container locking system can be used to secure the container. Thus, the manufacturer can ensure that only a lock that will work well with the container locking system will be used. (A simple padlock with an exposed staple or a very small solid lock could be used, but a thief could easily defeat such locks and so a user would not select such locks). Because the manufacturer can control the distribution of locks used with the container locking system, the manufacturer can ensure that a master key is always available to unlock a container in case the user looses the key provided with the lock. The manufacturer is also better able to provide a guarantee that the container locking system will resist a thief, since the manufacturer knows the quality of the lock being used.

Figure 8:
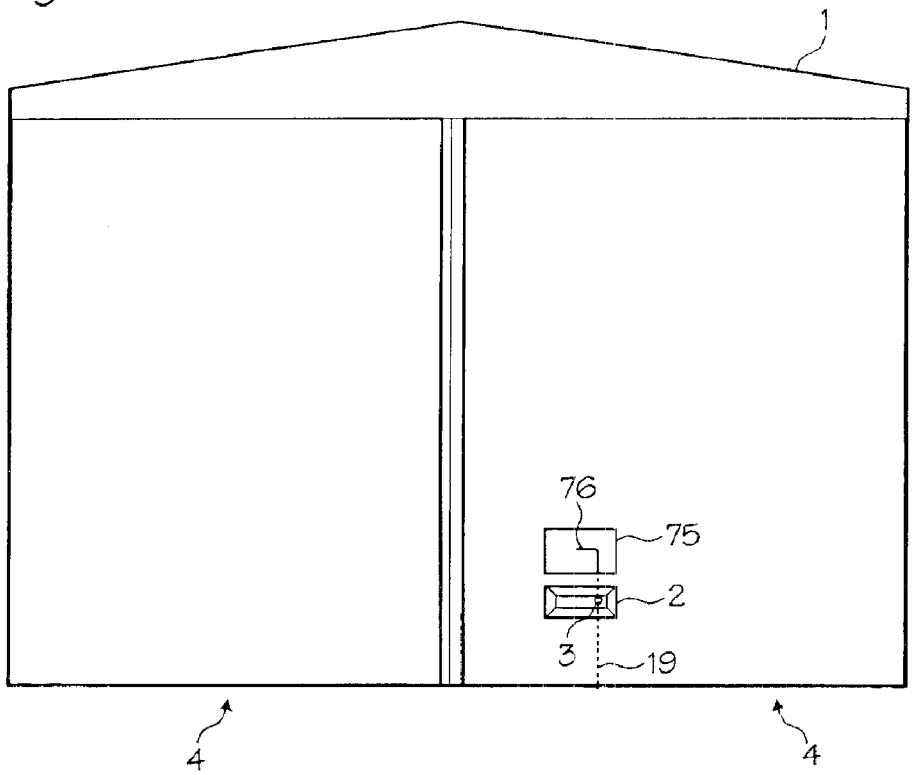
FIG. 8 shows another embodiment of the container locking system.

FIG. 8 shows another embodiment of the container locking system. A door 4 of the cargo container 1 is provided with a lock housing 2 (as described in FIGS. 1 through 6) and a corresponding, separate lock bar recess 75. A lock bar 18 extends from a lock bar housing 16 and into a lock bar recess 75. When a staple 46 is unlocked (there is no lock disposed through the staple) then a lock bar may be moved up and down or rotated by hand, thus enabling the door to be opened or secured. A user may move the lock bar by reaching into the lock bar recess and manipulating the lock bar by its handle 76. However, when a lock 3 is disposed in the staple then the lock bar may not be moved and the door may not be opened.

Figure 9:
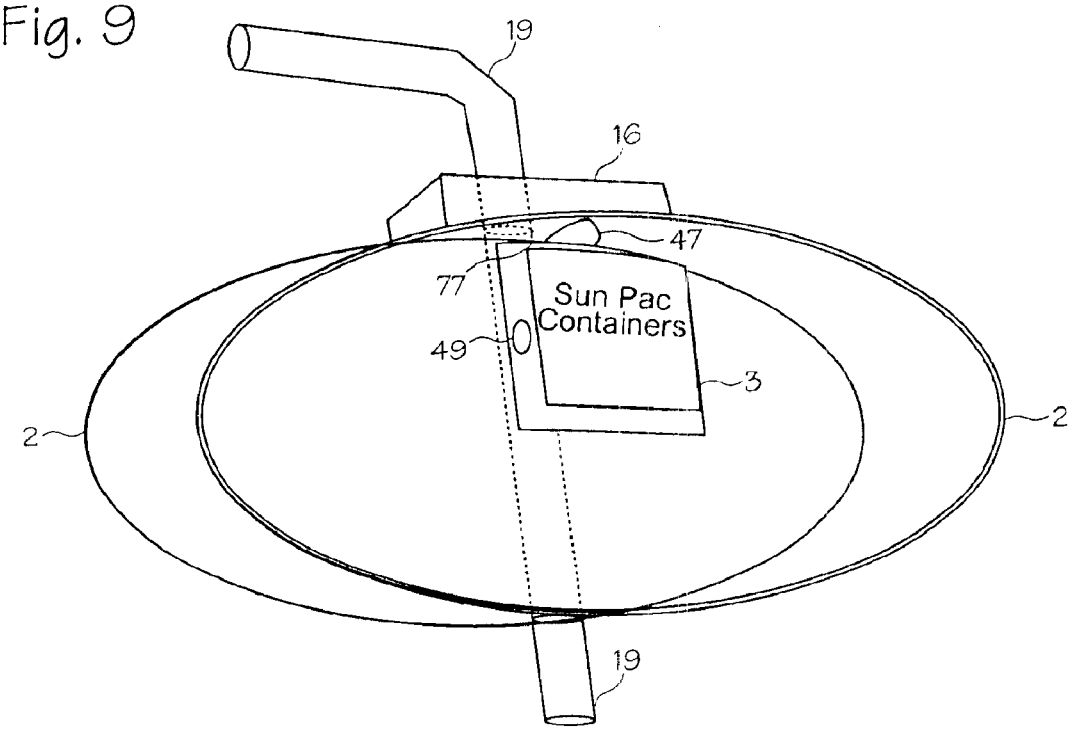
FIG. 9 shows another embodiment of the container locking system.

FIG. 9 shows another embodiment of the container locking system. The lock housing 2 comprises a circular or oval box instead of a rectangular box. (In general, the lock housing may comprise any shape, so long as it is difficult to manipulate tools larger than a key within the lock housing.) The lock 3 operates much the same way as the lock shown in FIG. 7; however, part of the case of the lock is sized and dimensioned to conform to the shape of the lock housing. Thus, the lock casing may be rectangular, but also has a semi-circular edge 77 so that the lock abuts the wall of the circular lock housing. In general, the lock may comprise any shape, so long as at least a portion of the lock edge abuts a corresponding portion of the wall of the lock housing or some other obstruction disposed on the lock housing. In addition, whatever the shape of the lock and the lock housing, the distance between the shackle and the edge of the lock casing abutting the wall may correspond to the distance between the hole in the staple and the slot in the wall.

The embodiment shown in FIG. 9 operates in a similar way to that previously shown. A lock bar 19 is disposed through a lock bar housing 16, and the lock bar may be selectively engaged with a corresponding hole in the container, thereby securing the container. The lock bar housing is attached behind the lock housing 2 and a slot 47 is provided between the lock bar housing and the lock housing. A staple 46 is attached to the lock bar and is disposed to protrude through the slot, from the lock bar housing, and to translate between the lock housing and the lock bar housing as the lock bar translates. (In other embodiments where the lock bar rotates, the staple will rotate with the lock bar).

In use, the container locking system may be provided inside a container door. The lock bars may be moved into and out of holes provided in the container, thereby locking and unlocking the container door. At least one of the lock bars is disposed through the lock bar housing, which is in turn disposed on the back of a lock housing. A staple may move through a slot provided between the lock bar housing and the lock housing. A hole is provided in the staple such that the shackle of a lock may be disposed through the hole in the staple. The slot and the lock may be sized and dimensioned such that when the lock shackle is disposed through the staple, the lock abuts one or more walls of the lock housing and fits snugly within the lock housing.

When the locking system is to be locked the lock shackle is placed through the hole in the staple. The body of the lock then prevents the staple from moving through the slot. Since the staple is attached to the lock bar, the lock bar cannot be moved either manually or by the lock bar or door operating mechanism. Thus, the container locking system secures the container. When the distance between the shackle and the lock housing wall (or obstructing object) corresponds to the distance between the staple aperture and the lock housing wall (or obstructing object), the lock will fit snugly within the lock housing. Thus, the lock will be more difficult to tamper with. Similarly, the shape of lock may be keyed to the shape of the lock housing so that the lock fits securely within the housing, thereby further securing the locking system and hindering the use of locks other than those produced by the manufacturer.

To unlock the locking system, the lock is removed from the staple. The staple may then pass through the slot, thereby allowing the lock bars to move by either manual manipulation or by the operation of the lock bar operating mechanism. The lock bars may then be selectively engaged with whatever corresponding holes or securing guides are provided with the container. When the lock bars are disengaged from the holes or securing guides, the container doors may be easily opened.

An opening mechanism may be provided with the container door such that the opening mechanism can easily move the lock bars in and out of the holes in the container when the locking system is unlocked. (Another lock may be used to provide additional security to the door closure system, as mentioned above in relation to FIG. 1). However, the container locking system may be provided to a door without a container opening mechanism or a lock bar translating mechanism (the lock bar would be translated manually).

The distributor of storage containers may distribute many containers with the locking system described above, which may be retrofitted onto existing containers or built into new containers. Because the locks are uniquely mated to the containers, customers cannot, without undue effort, use locks of their own. In this manner, the distributor can hold keys to the locks, so that the distributor himself can open the containers even when customers lose keys provided to them by the distributor. Otherwise, if customers were permitted to use their own locks, the distributor would be unable to assist a customer who has lost their key, or open an abandoned container, without undertaking the very difficult task of breaking into the container.

The container locking system may be sized and dimensioned to work with any door, window, or closure. In addition, other embodiments of the devices described above are possible. The lock housing need not be a rectangular box and may comprise many different shapes, such as an open semi-spherical recess, or customized shapes that allow access by a hand with a key but deny access to most other tools. Similarly the lock housing may comprise a recess indented into the container door or housing.

The slot between the lock housing (or recess) and the lock bar housing may comprise any shape or be disposed anywhere relative to the lock bar and lock housings, so long as the staple is capable of moving between the housings (and thus allowing the lock bar to be disengaged from the corresponding holes in the container).

An obstructing structure may be provided within the lock housing that will prevent the lock from moving when the lock is secured to the staple. The lock may then abut either the obstructing structure or the structure and a surface of the lock housing. Thus, when an obstructing structure is provided, the lock need not abut a wall or surface of the lock housing to be snugly fit within the lock housing. The obstructing structure may comprise a bar, protrusion from the recess, a protrusion from the door, or comprise any other object having a shape disposed to prevent the lock from moving when the lock is secured to the staple.

Any lock may be used with the systems and devices described above (such as combination locks, electronic locks, or other locks). Each of these types of locks may be sized and dimensioned to abut one or more walls of the lock housing. More generally, the lock shape may be fashioned to conform to or be keyed to whatever shape the lock housing has. For example, if the lock housing is spherical then at least a portion of the lock casing may be provided with a matching spherical shape. Whatever the shape of the lock and the lock housing, the distance from the shackle to an exterior surface of the lock may correspond to the distance from the shackle receiving hole and a surface of the recess (or an obstructing structure) when the staple is disposed within the recess. Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A cargo container comprising:

a container having at least one door, said door having an inside and an outside and said door having an opening;

a lock housing attached to the inside of the door, said lock housing comprising a box, wherein one side of the lock housing is open to the outside of the door, and wherein the open side of the lock housing is disposed against the opening in the door;

a lock bar housing attached to the lock housing;

a lock bar disposed within the lock bar housing, said lock bar moveable within the lock bar housing and within the container, said lock bar being movable into and out of a corresponding hole disposed within the container such that when the lock bar is disposed in the hole the container door may not be opened;

a slot disposed in the lock housing, said slot communicating from the lock housing to the lock bar housing; and a staple attached to the lock bar, said staple having a hole suitable for receiving a shackle of a lock, wherein when unsecured the staple may move in and out of the slot as the lock bar moves, wherein when the staple is in the slot a user may reach into the lock housing and secure the lock shackle through the hole in the staple, and wherein the staple may not move out of the slot when secured by the lock.

2. The container of claim 1 further comprising a door closure system operably connected to the door and to the lock bar, said door closure system capable of moving the lock bar into and out of the corresponding hole in the container, said door closure system further capable of being operated by a user outside the door, and wherein the door closure system is restricted from moving the lock bar when the lock is engaged.

3. The container of claim 2 wherein the lock housing has dimensions of about 6.5 inches wide, about 4.5 inches tall and about 6 inches deep relative to the door.

4. The container of claim 1 further comprising a lock having a shackle, wherein the shackle may be disposed through the staple.

5. The container of claim 4 wherein the lock is sized and dimensioned to abut a wall of the lock housing, and wherein the distance between the shackle and one edge of the lock that abuts the wall is approximately equal to the distance between the hole in the staple and the wall of the lock housing.

6. A cargo container comprising:

a container having at least one door, said door having an inside and an outside and said door having an opening;

a lock housing attached to the inside of the door, said lock housing comprising a rectangular box comprised of a durable material, wherein one side of the a lock housing is open and wherein the open side of the lock housing is disposed against the opening in the door;

wherein the lock housing is sized and dimensioned to allow a human hand holding a small tool to access a lock disposed in the lock housing, and wherein the lock housing is further sized and dimensioned to hamper the use of larger tools on the lock;

a lock bar housing attached to the lock housing;

a lock bar disposed within the lock bar housing, said lock bar moveable within the lock bar housing and within the container, said lock bar being movable into and out of a corresponding hole disposed within the container such that when the lock bar is disposed in the hole the container door may not be opened;

a slot disposed between the lock bar housing and the lock housing; and a staple attached to the lock bar, said staple having a hole suitable for receiving a shackle of a lock, wherein when unsecured the staple may move in and out of the slot as the lock bar moves, wherein when the staple is in the slot a user may reach into the lock housing and secure the lock shackle through the hole in the staple, and wherein the staple may not move out of the slot when secured by the lock.

7. The container of claim 6 further comprising a door closure system operably connected to the door and to the lock bar, said door closure system capable of moving the lock bar into and out of the corresponding hole in the container, said door closure system further capable of being operated by a user outside the door, and wherein the door closure system is restricted from moving the lock bar when the lock is engaged.

8. The container of claim 7 wherein the lock housing has dimensions of about 6.5 inches wide, about 4.5 inches tall and about 6 inches deep relative to the door.

9. The container of claim 6 further comprising a lock having a shackle, wherein the shackle may be disposed through the staple.

10. The container of claim 9 wherein the lock is sized and dimensioned to abut a wall of the lock housing, and wherein the distance between the shackle and one edge of the lock that abuts the wall is approximately equal to the distance between the hole in the staple and the wall of the lock housing.

11. A locking system suitable for securing a door, said system comprising:

a lock housing, said lock housing comprising a box, wherein one side of the lock housing is open, and wherein the open side of the lock housing may be accessed by a user outside the door;

wherein the lock housing is sized and dimensioned to allow a human hand holding a small tool to access a lock disposed in the lock housing, and wherein the lock housing is further sized and dimensioned to hamper the use of larger tools on the lock;

a lock bar housing attached to the lock housing;

a lock bar disposed within the lock bar housing, said lock bar moveable within the lock bar housing and said lock bar suitable for securing the door;

a slot disposed between the lock bar housing and the lock housing; and a staple attached to the lock bar, said staple having a hole suitable for receiving a shackle of a lock, wherein when unsecured the staple may move in and out of the slot as the lock bar moves, wherein when the staple is in the slot a user may reach into the lock housing and secure the lock shackle through the hole in the staple, and wherein the staple may not move out of the slot when secured by the lock.

12. The locking system of claim 11 wherein the lock housing has dimensions of about 6.5 inches wide, about 4.5 inches tall and about 6 inches deep relative to the door.

13. The locking system of claim 11 further comprising a lock having a shackle, wherein the shackle may be disposed through the staple.

14. The locking system of claim 13 wherein the lock is sized and dimensioned to abut a wall of the lock housing, and wherein the distance between the shackle and one edge of the lock that abuts the wall is approximately equal to the distance between the hole in the staple and the wall of the lock housing.

15. A secure container system comprising:

a storage container having a door, said container characterized by an inner surface, said door characterized by an inner surface and an outer surface;

a door closure system comprising a lock bar and lock bar translating mechanism operable to move the lock bar into a receiving aperture in the container inner surface;

a recess disposed on the door outer surface, said recess having a back surface which is in a plane substantially parallel to the door outer surface, said recess having a slot for receiving a staple from the interior of the container;

a staple extending from the lock bar, said staple sized and dimensioned to extend through the slot and into the recess when the lock bar is translated into the receiving aperture, said staple having a hole for receiving a shackle of a pad lock, and wherein the staple may move in and out of the slot between the recess and the interior of the container;

a pad lock having a staple aperture for receiving the staple, and a shackle operable to pass through the staple aperture, wherein the distance from the staple aperture opening to the shackle corresponds to the distance from the recess back surface to the shackle receiving hole when the staple is disposed within the recess.

16. The secure container system of claim 15 wherein:

the pad lock shape is keyed to the shape of the recess, such that the distance from the shackle to an exterior surface of the lock corresponds to the distance from the shackle receiving hole and a surface of the recess when the staple is disposed within the recess.

17. The secure container system of claim 15 wherein:

the pad lock shape is keyed to the shape of the recess, such that the distance from the shackle to an exterior surface of the lock corresponds to the distance from the shackle receiving hole and an obstructing structure within the recess when the staple is disposed within the recess.

18. The secure container system of claim 15 wherein the recess comprises an open sided box secured to the door behind an aperture in the door.

19. The secure container system of claim 15 wherein the recess comprises an open sided rectangular box secured to the door behind an aperture in the door, said box having a top wall and a back wall, and a staple receiving slot extending through the top wall and back wall.

* * * * *